US010933291B2

(12) United States Patent
Papadopoulos

(10) Patent No.: US 10,933,291 B2
(45) Date of Patent: Mar. 2, 2021

(54) BICYCLE TRAINER PERMITTING STEERING AND TILTING MOTION

(71) Applicant: Larry C. Papadopoulos, North Plains, OR (US)

(72) Inventor: Larry C. Papadopoulos, North Plains, OR (US)

( * ) Notice: Subject to any disclaimer, the term of this patent is extended or adjusted under 35 U.S.C. 154(b) by 0 days.

(21) Appl. No.: 16/121,957

(22) Filed: Sep. 5, 2018

(65) Prior Publication Data

US 2018/0369675 A1 Dec. 27, 2018

Related U.S. Application Data

(63) Continuation-in-part of application No. PCT/US2017/045730, filed on Aug. 7, 2017.

(60) Provisional application No. 62/371,658, filed on Aug. 5, 2016.

(51) Int. Cl.
*A63B 69/16* (2006.01)
*A63B 71/00* (2006.01)

(52) U.S. Cl.
CPC ..... *A63B 69/16* (2013.01); *A63B 2069/162* (2013.01); *A63B 2069/165* (2013.01); *A63B 2069/167* (2013.01); *A63B 2069/168* (2013.01); *A63B 2071/0072* (2013.01); *A63B 2210/50* (2013.01)

(58) Field of Classification Search
CPC ..... A63B 2069/161; A63B 2069/162; A63B 2069/163; A63B 2069/164; A63B 2069/165; A63B 2069/166; A63B 2069/167; A63B 2069/168; A63B 69/16; A63B 22/06; A63B 22/0605; A63B 22/0664
See application file for complete search history.

(56) References Cited

U.S. PATENT DOCUMENTS 5,042,795 A * 8/1991 Bursik ..... A63B 69/16 482/61
5,480,366 A * 1/1996 Harnden ..... A63B 69/16 482/57

(Continued)

FOREIGN PATENT DOCUMENTS

WO 2018027216 A1 2/2018

OTHER PUBLICATIONS

Minoura Co., Ltd. 'Action Bridge'. Retrieved from the Internet: <URL: https://web.archive.org/web/20150524200628/http://www.minoura.jp/english/trainer-e/option-e/bridge-e.html> May 24, 2015.

*Primary Examiner* — Garrett K Atkinson
*Assistant Examiner* — Zachary T Moore
(74) *Attorney, Agent, or Firm* — Timothy E. Siegel Patent Law, PLLC; Timothy E. Siegel

(57) ABSTRACT

A bicycle rollers assembly (10) having a rear and a front and further having a rear pair of parallel rollers (12) each having an axis of rotation, and adapted to support a rear bicycle wheel having an axle parallel to the axes of rotation. The rollers (12) are spaced so as to support the rear bicycle wheel with the lowest part of the bicycle wheel positioned between the rollers. Also, a front support structure (18) supports a front bicycle fork support element (24) so as to permit horizontal rotation, and this support element includes a support (26) for each arm of a bicycle fork (29).

9 Claims, 10 Drawing Sheets

(56) References Cited

U.S. PATENT DOCUMENTS

| | | | | |
|---|---|---|---|---|
| 6,530,864 | B1 * | 3/2003 | Parks | A63B 69/16 482/4 |
| 6,857,992 | B1 | 2/2005 | Kolda et al. | |
| 7,481,746 | B2 | 1/2009 | Ibarguren | |
| 2004/0053751 | A1 | 3/2004 | Pizolato | |
| 2005/0209064 | A1 * | 9/2005 | Peterson | A63B 69/16 482/61 |
| 2006/0234839 | A1 * | 10/2006 | Peterson | A63B 69/16 482/61 |
| 2008/0269025 | A1 | 10/2008 | Badarneh et al. | |
| 2010/0234188 | A1 * | 9/2010 | Wan | A63B 21/15 482/61 |
| 2011/0218080 | A1 * | 9/2011 | Papadopoulos | A63B 69/16 482/61 |
| 2011/0287902 | A1 * | 11/2011 | Bingham, Jr. | A63B 21/00069 482/61 |
| 2013/0053223 | A1 * | 2/2013 | Shu-Chiung | A63B 69/16 482/61 |
| 2015/0217158 | A1 | 8/2015 | Colan | |

* cited by examiner

BICYCLE TRAINER PERMITTING STEERING AND TILTING MOTION

RELATED APPLICATIONS

This application is a continuation-in-part of international application PCT/US17/45730, which was filed Aug. 7, 2017, in the US Receiving Office, which claims priority from provisional application 62/371,658, filed Aug. 5, 2016. Both of the aforementioned applications are incorporated by reference as if fully set forth herein.

TECHNICAL FIELD

The present invention is in the field of bicycle trainers that accept a bicycle and wherein a user rides the bicycle on the bicycle trainer and can move the handlebars.

BACKGROUND ART

Although to the casual observer it might appear that a person bicycling along a straight road is progressing at an even speed and in a straight line, a closer examination reveals that this is not the case. Rather, there is a subtle side to side movement caused by a shifting of the rider's weight as he peddles. Although he may be unaware of this, the rider must counter this movement by maintaining a good grip on the handle bars, and resisting the tendency of the bicycle to turn, in response to this weight shifting. Also, the speed of the cyclist undergoes a subtle variation over the peddling cycle.

Many exercise devices, such as stationary bikes, that attempt to mimic the feel of riding a bicycle provide an unsatisfactory feel for the rider, particularly if the rider is a frequent bicyclist. Part of the reason for this is the lack of sideways motion permitted by these devices, so that the rider does not move in the same way as he does on an actual bicycle ride.

SUMMARY

In a first separate aspect, the present invention may take the form of a bicycle training assembly having a rear and a front and including a bicycle portion, including a bicycle frame including a rear wheel mount, pedals attached to a front sprocket, bicycle chain, seat, handlebar and front bicycle fork. Also, a front support assembly, includes a base; a front bicycle fork support element horizontally rotatably mounted on the base at a hinge point so as to permit horizontal rotation, and that includes a fork mount, supporting the bicycle fork, and which is displaced from the hinge point, so that as the support element rotates the fork mount revolves about the hinge point. Finally, a rear support assembly supports the rear wheel mount, and is engaged to the chain so as to permit and resist chain travel caused by rotation of the front sprocket, and which permits the frame to roll from side to side.

In a second separate aspect, the present invention may take the form of a bicycle trainer having a base and a front bicycle fork support element horizontally rotatably mounted on the base at a hinge point so as to permit horizontal rotation, and that includes a fork mount, adapted to support a front wheel bicycle fork, the fork mount being displaced from the hinge point, so that as the support element rotates the fork mount revolves about the hinge point.

In a third separate aspect, the present invention may take the form of a bicycle rear wheel mount support assembly, having a base, and a housing supported by the base. Also, a sprocket set assembly, has a sprocket support and rotation resistance assembly, housed in the housing, and adapted to rotatably support and provide rotation resistance to a further element and a sprocket set, rotatably supported by the sprocket support and rotation resistance assembly, which permits but resists rotation thereof. Finally, a base support supports the base and permits the base and the sprocket set assembly to roll from side to side, within a limited range.

In a fourth separate aspect, the present invention may take the form of a method of bicycle training that includes providing an assembly having a rear and a front and further having a bicycle portion, including a bicycle frame including a rear wheel mount, pedals attached to a front sprocket, bicycle chain, seat, handlebar and front bicycle fork; a front support assembly, including: a base; a front bicycle fork support element horizontally rotatably mounted on the base at a hinge point so as to permit horizontal rotation, and that includes a fork mount, supporting the bicycle fork, and displaced from the hinge point, so that as the support element rotates the fork mount revolves about the hinge point; and a rear support assembly, supporting the rear wheel mount, and engaged to the chain so as to permit and resist chain travel caused by rotation of the front sprocket, and permitting the frame to roll from side to side. The method includes mounting the bicycle portion and peddling, and turning the handle bar, thereby causing the front bicycle fork support assembly to turn, so that the bicycle frame tilts.

DETAILED DESCRIPTION OF THE PREFERRED EMBODIMENTS

Figure 1:
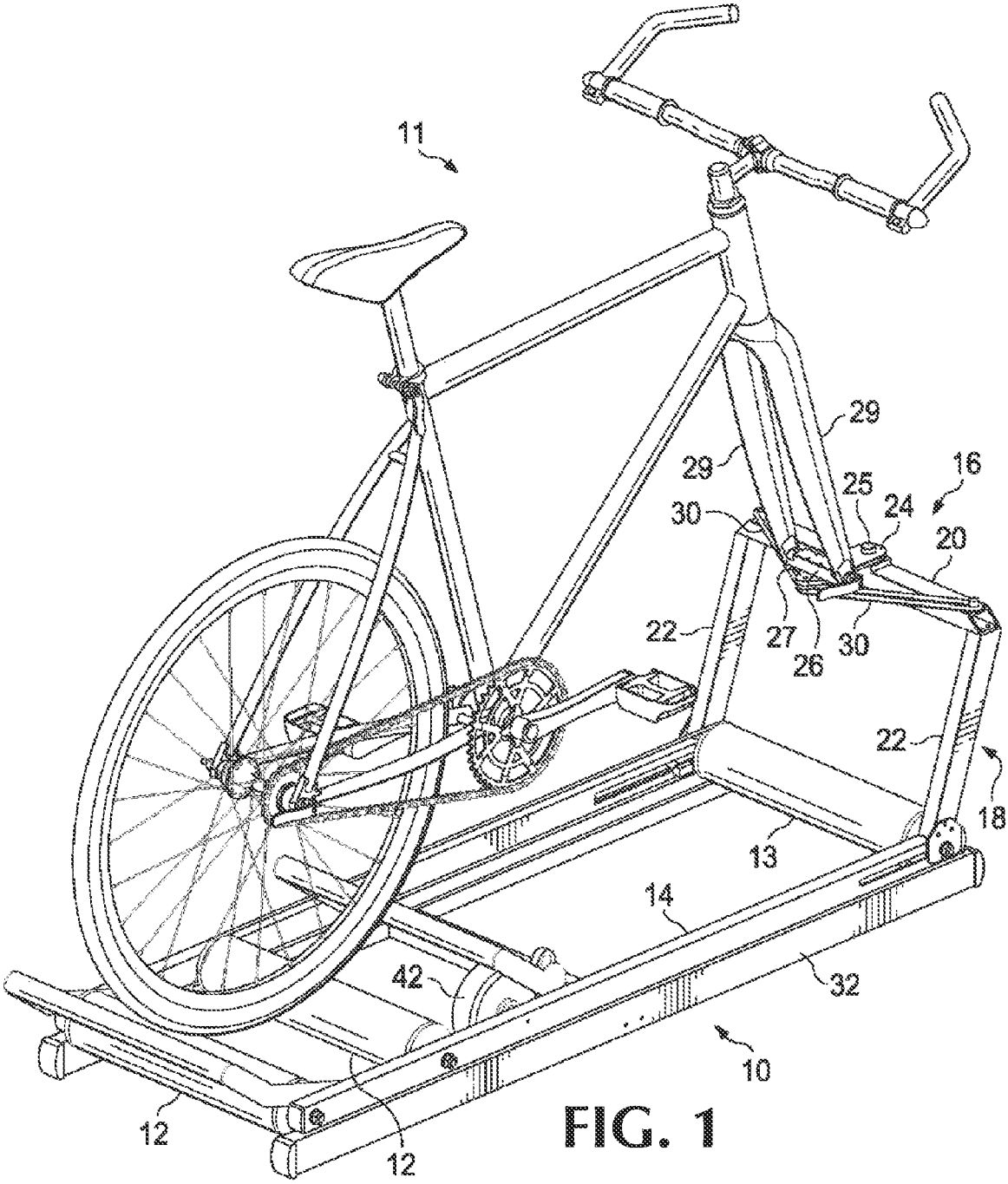
FIG. 1 is a top side rear isometric view of a bicycle rollers assembly, according to the present invention, hosting a bicycle, with the handlebars straight.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
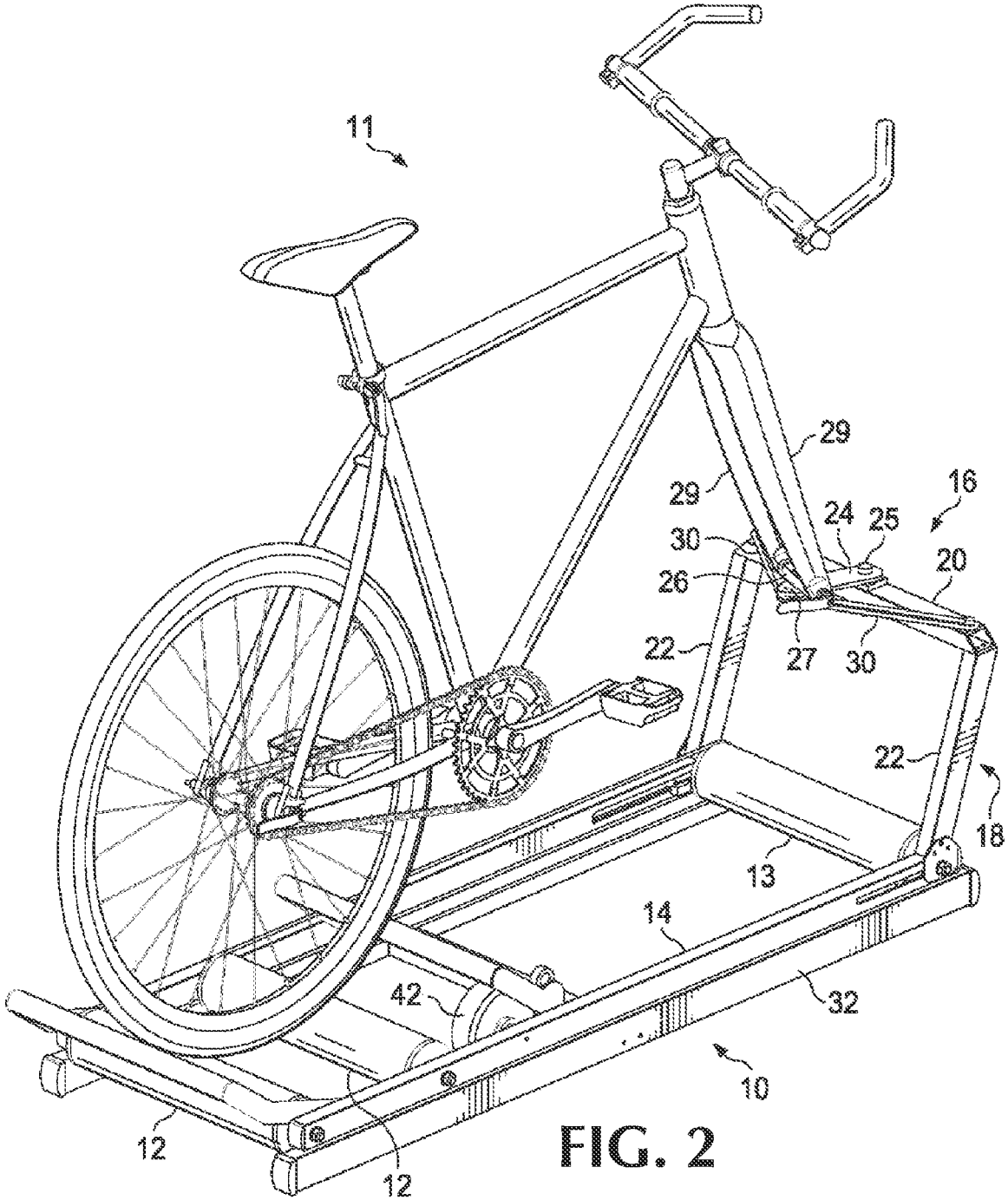
FIG. 2 is the same view as FIG. 1, but with the bicycle handlebars turned slightly to the right.
Figure 3:
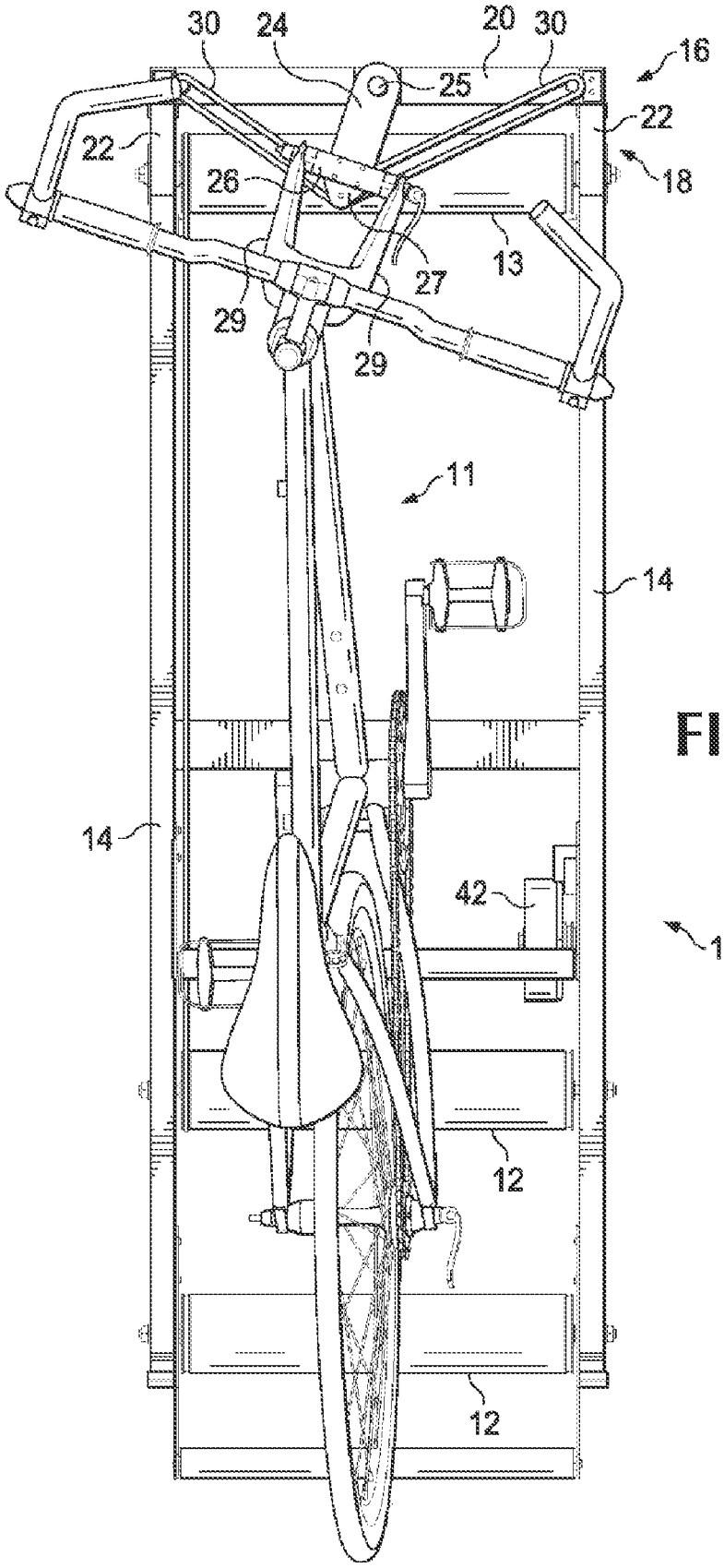
FIG. 3 is a top view of the assembly of FIG. 1
Figure 4:
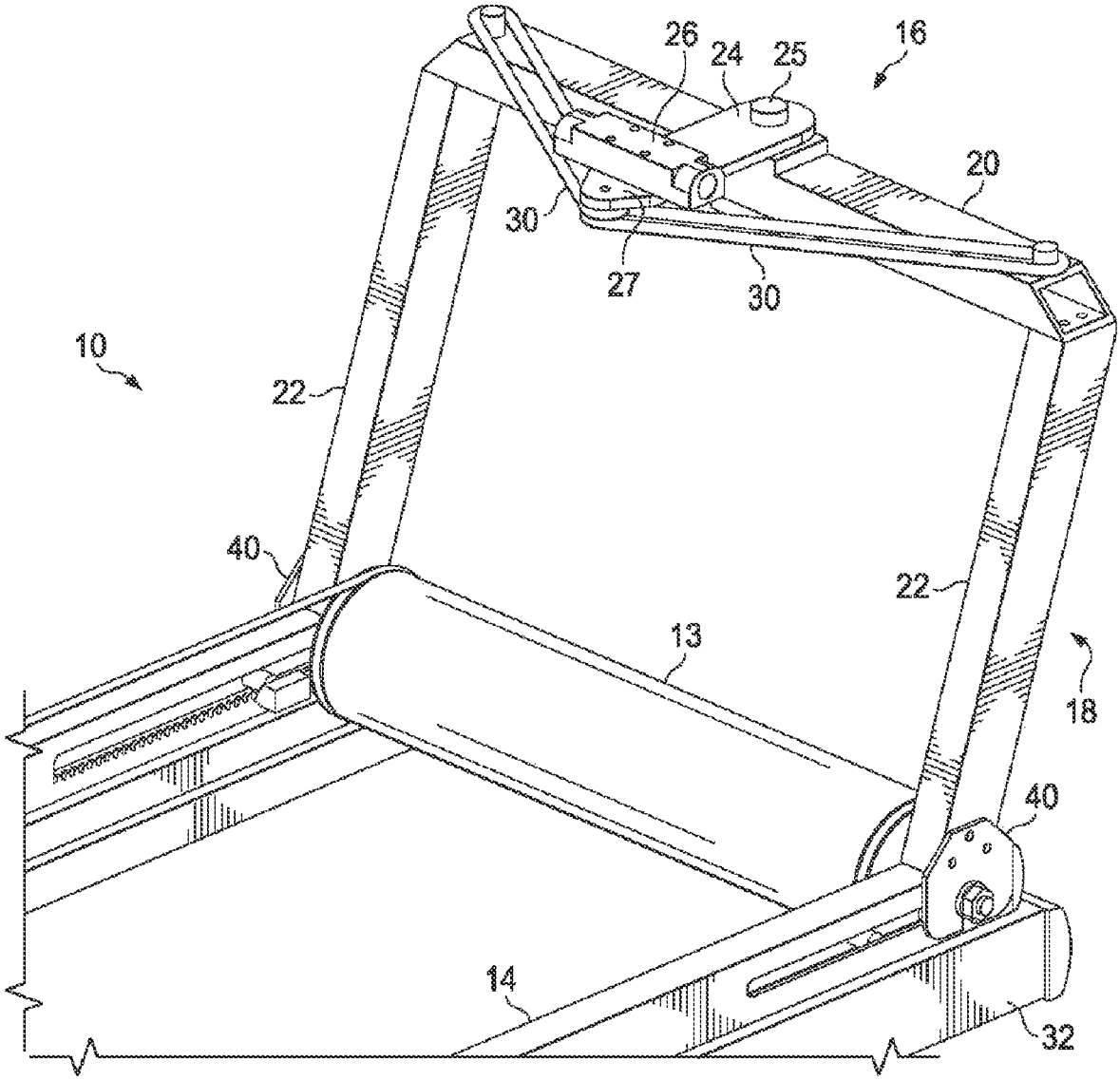
FIG. 4 is a top side rear view of the front of the assembly of FIG. 1, with no bicycle hosted on it.

Referring to FIGS. 1 and 4, a modified bicycle rollers assembly 10, shown hosting a bicycle 11 (in FIGS. 1-3), includes a rear pair of rollers 12, and a front roller 13, mounted on a frame 14 and a front bicycle fork supporting assembly 16, including a U-frame 18, having a center bar 20 and two side supports 22, which are attached to the front part of the frame 14. At the center of the center bar 20 is a front fork support 24 that is rotatably mounted at a pivot point 25. Support 24 includes a rear projection 27 that includes a support 26 for each of the arms 29 of a bicycle fork. A pair of springs, in the form of rubber bands, 30, one in either sideways direction, are each mounted between a post (not shown) extending downwardly from fork support 24 and a side support 22. These rubber bands 30 resist side-to-side turning, as shown in FIGS. 2 and 3.

As fork support 26 and the attached fork rotate off of center, the rotated bicycle fork generates an off-vertical tilt to the bicycle frame. Inversely, pedaling forces create a tilt to the bike frame that will result in a steering action. Thus, the rider is able to modulate tilt by controlling the steering. Additionally, the resistance of rubber bands 30 to the rotation of fork support 26 play a role in stabilizing the bicycle on assembly 10 and preventing excessive tilt, while also, to some degree, mimicking the resistance to steering encountered by friction between the bicycle wheel and the road surface.

This configuration may be originated by retrofitting an existing bicycle rollers assembly, by providing a front bicycle fork supporting assembly 16 that bolts onto the frame 14 at the location of the front roller 13. Stabilizing plates 40 (FIG. 4), a part of assembly 16, help to stabilize U-frame 18. In one preferred embodiment, frame 14 is an inner frame, which is set into an outer or bottom frame 32 in a manner that permits resisted movement between frame 14 and frame 32, to more effectively mimic the feel of actual bicycling.

Similar to other bicycle rollers assemblies, assembly 10 includes a subassembly 42 to provide resistance to the turning of the front rear roller, to provide a more realistic feel and different exertion levels. Frames 14 and 32 are made of aluminum and separated by wheels or rollers to permit movement of top frame 14. The motion is gently resisted by a bungee or other form of spring (not shown).

Figure 5:
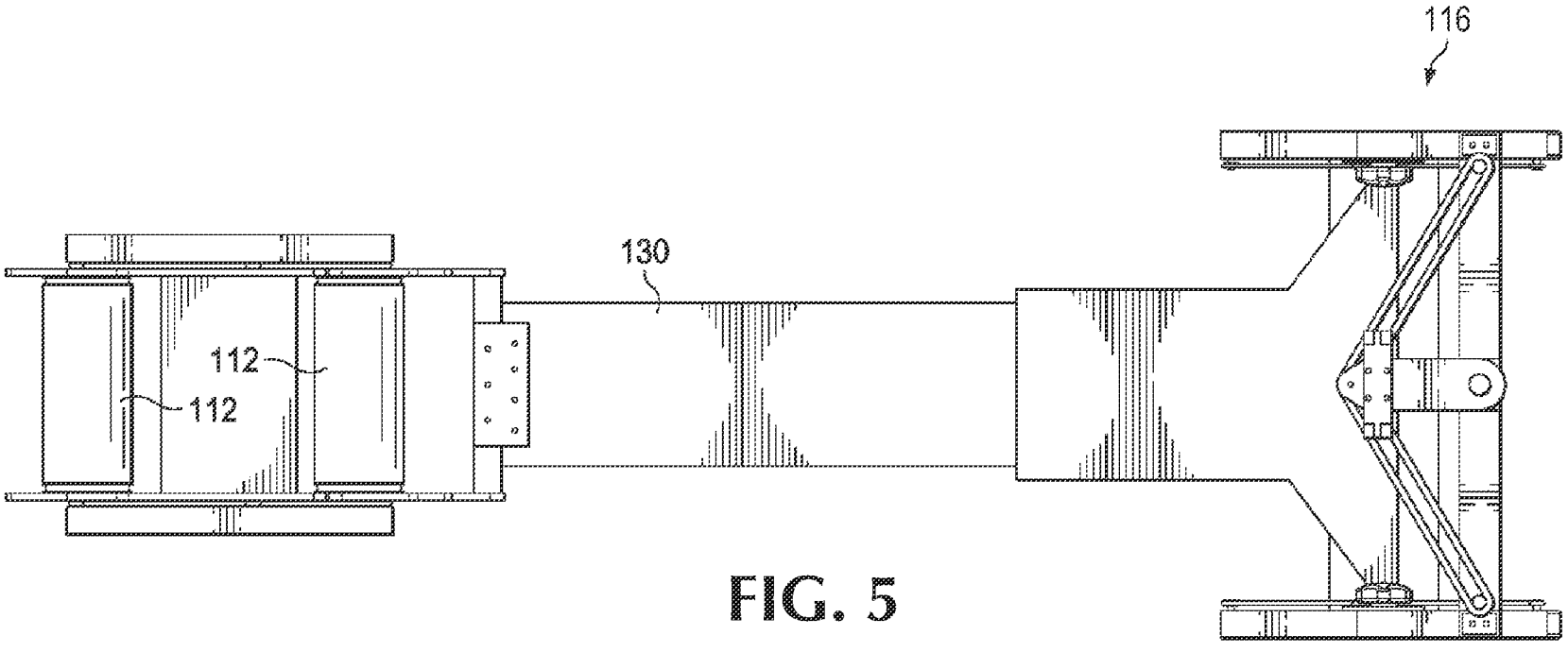
FIG. 5 is a top view of an alternative embodiment of a bicycle rollers assembly.

Referring to FIG. 5, in an alternative preferred embodiment, a bicycle rollers assembly 110, similar to assembly 10, may be especially purpose-built. In this assembly, there would typically not be a front roller 13 (FIG. 1), but only the front bicycle fork supporting assembly 116 at the front. Also, although in a conventional bicycle rollers assembly some width is needed to permit side-to-side wandering in the steering, when the front fork is bolted in place this width is no longer needed and the entire assembly can be made substantially narrower, with the width of the rear rollers 112 and the bridge 130 connecting front assembly 116 to rear rollers 112, being as little as 15 cm (6 in) or less. This embodiment permits a substantial savings in materials and in the weight of the full assembly, thereby permitting easier portability for a user.

Assemblies 10 and 110, each have a more realistic feel to the rider, as the natural side-to-side motion of the handlebars, imparted by peddling, is resisted by the rider. Although the rider may be unaware that he is even making this effort as part of the exercise of riding a bicycle, he or she may notice a subtle difference between the bicycle riding experience and the experience of riding a bicycle mounted on a frame. The assembly may be made lighter and narrower, however, greatly facilitating transportability and easy storage. Similar to assembly 10, assembly 110 includes a rear roller resistance mechanism and can be set into an outer frame, so that it can move slightly forward and backward.

Figure 6:
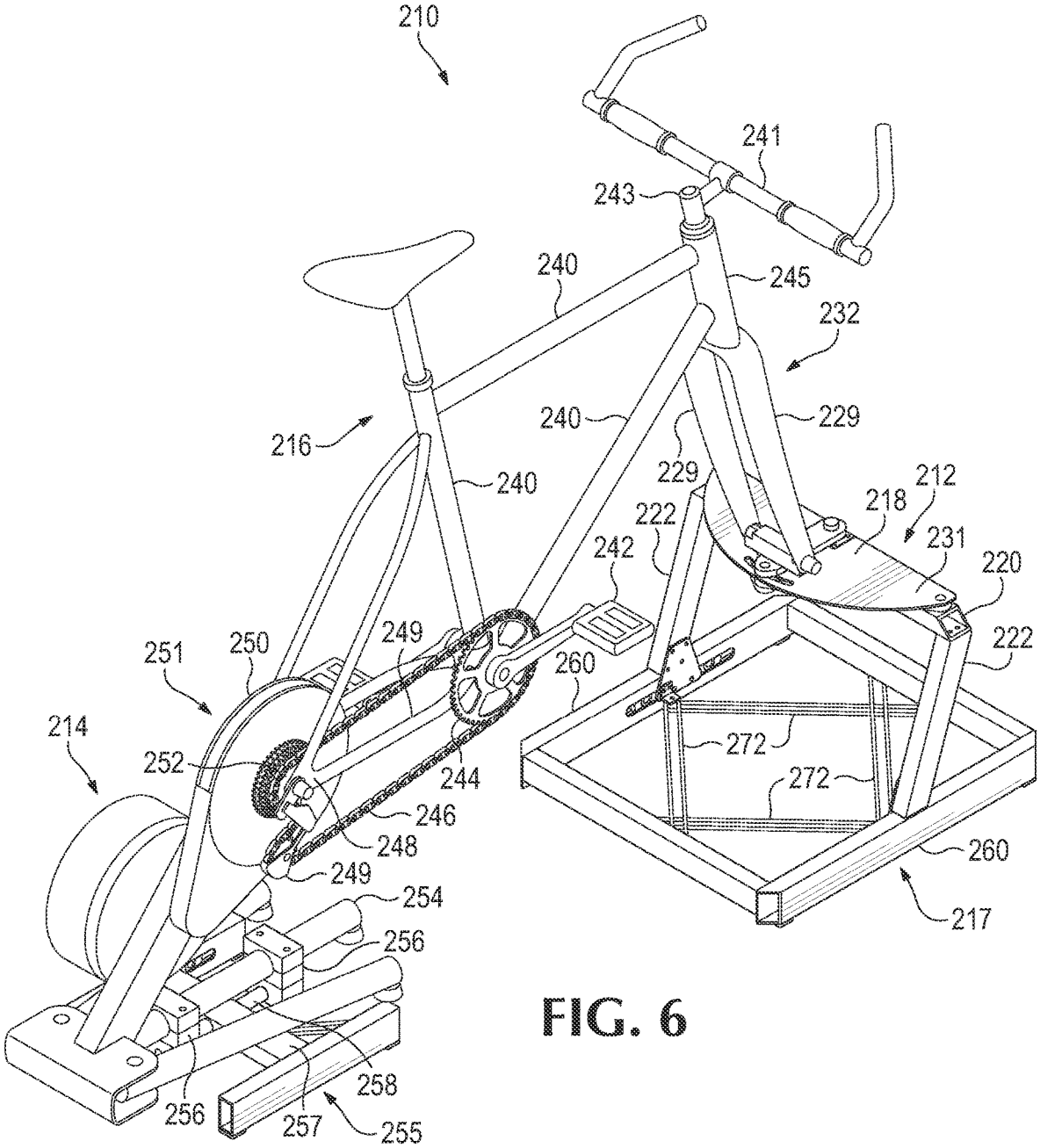
FIG. 6 is an isometric view of a bicycle trainer according to an alternative embodiment of the present invention.
Figure 7:
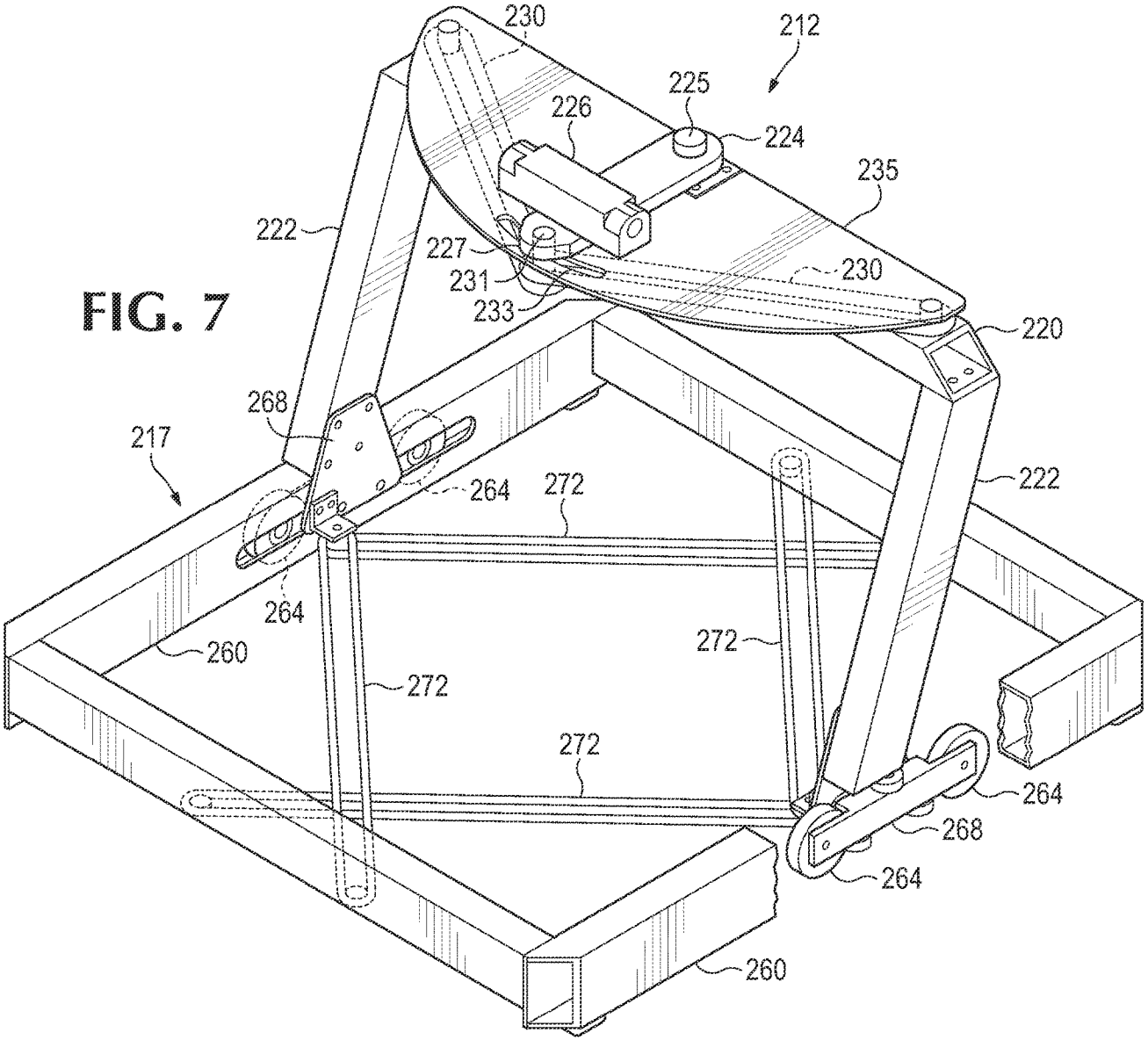
FIG. 7 is an isometric and cut-away view of the front portion of the bicycle trainer of FIG. 6.

Referring now to FIGS. 6 and 7, a bicycle training assembly 210 comprises a front support assembly 212, a rear support assembly 214 and a bicycle portion 216 connecting assemblies 212 and 214. Similar to embodiment 10, the front support assembly 212, includes a base 217, that includes a U-frame 218, having a center bar 220 and two side supports 222. At the center of the center bar 220 is a front fork support element 224 that is rotatably mounted at a pivot or hinge point 225. Support element 224 includes a rear projection 227 that includes a support 226 for each of the arms 229 of a front wheel fork 232. A post 231 extends from rear projection 227, through a slot 233 in a plate 235, which helps support projection 227. A pair of springs, in the form of rubber bands, 230, one in either sideways direction, are each mounted between post 231, and a side support 222. These rubber bands 230 provide resistance to (while permitting) side-to-side turning of support element 224, as shown in FIG. 9.

Bicycle portion 216 includes a bicycle frame 240, a handlebar 241 connected to the front wheel fork 232. Also, a pair of pedals 242 drive a front sprocket 244, which drives a bicycle chain 246. A rear wheel mount 248 permits the frame 240 to accept a bicycle wheel or to be mounted to a device designed to mimic the feel of cycling.

Supporting bicycle portion 216 at its rear wheel mount 248 is the rear support assembly 214, having a rear wheel mount support assembly 250, which in one embodiment is a Wahoo Kickr®, which may be purchased from Wahoo Fitness LLC, a Georgia LLC, which maintains a website having web address www.wahoofitness.com. FIG. 6 shows a simplified version of the Wahoo Kickr®, acting as a rear wheel mount support assembly 250, which includes a set of different sized sprockets, which is supported by other portions of the Kickr®, so that, as skilled persons will readily recognize, these other portions may be termed a sprocket set support. The user engages the bicycle chain 246 to a rear sprocket set 252 and moves it from one rear sprocket to another rear sprocket with the bicycle derailleur 249. The rear wheel mount support assembly 250 includes as skilled persons will readily recognize, a mechanism that is an integral part of assembly 250, that rotatably supports the sprocket set 252, and permits but resists rotation, including a fly wheel to mimic the momentum of a bicycle on the road, and a magnetic brake assembly, to mimic road and wind resistance. The Wahoo Kickr®, has a central horizontal leg 254, which together with its two companion legs, as shown, may be termed a rear wheel mount support assembly base, that is retained in a rear base 255, by a pair of yolks 256, that are in turn mounted on an axle 258, so as to permit rotation, thereby permitting rear wheel mount support assembly 250 to roll from side-to-side, as the user tilts portion 216 by turning handle bar 241. In one embodiment this rotation is gently resisted by elastomeric members. A base cross-member 257 supports axle 258.

Figure 9:
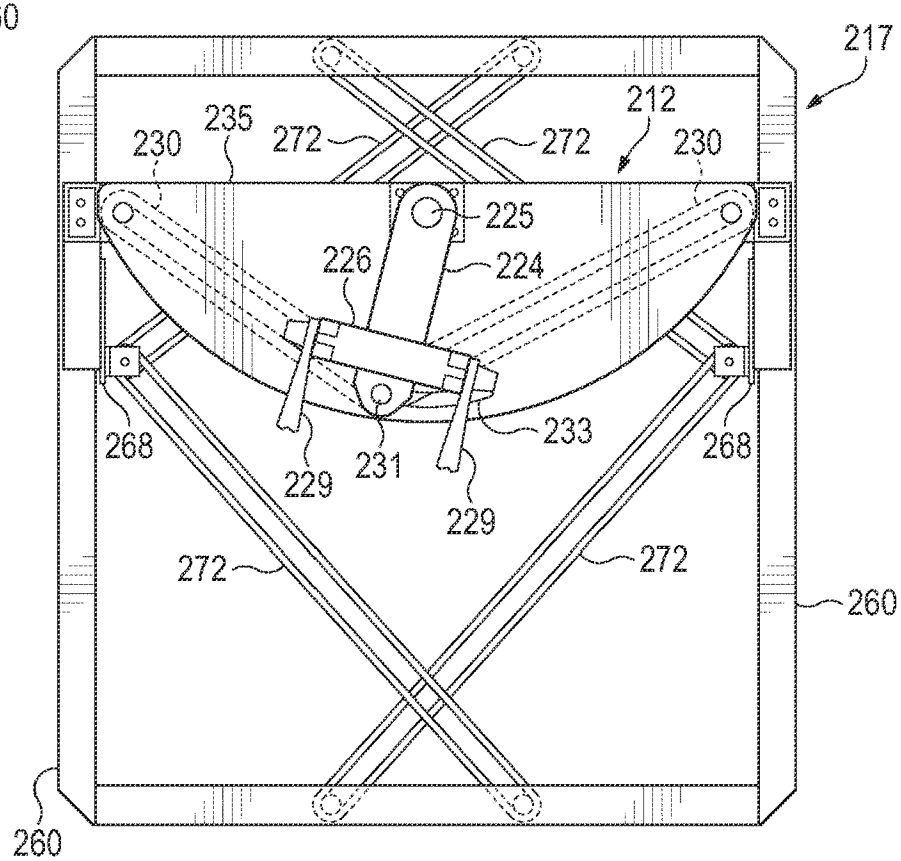
FIG. 9 is a top of the portion of FIG. 6, with the front fork support turned.
Figure 8:
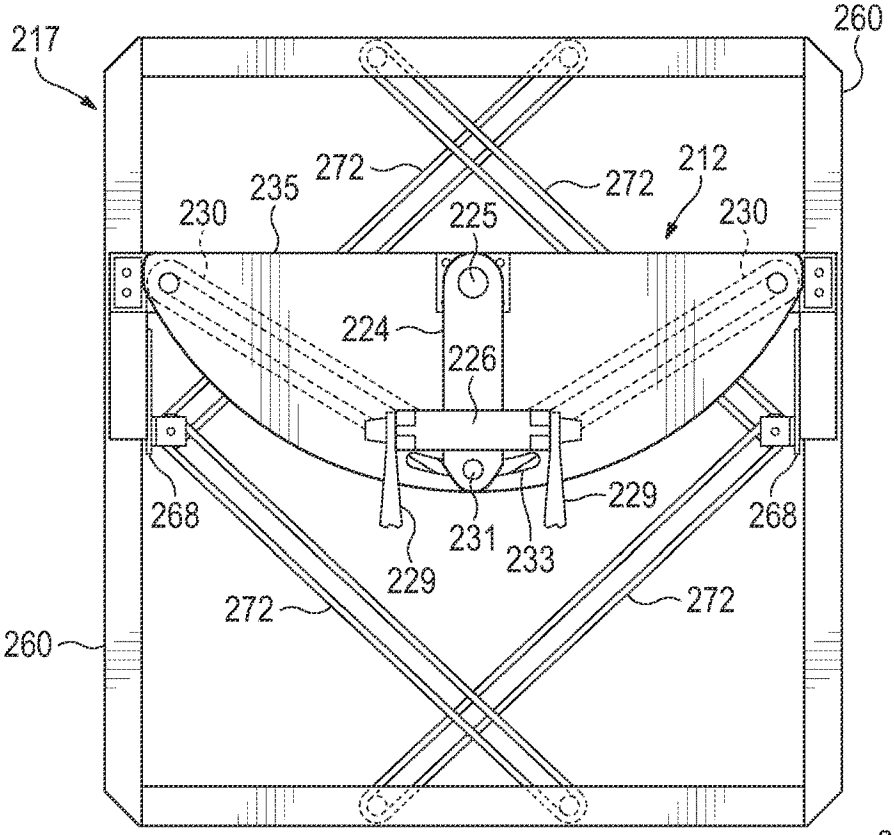
FIG. 8 is a top view of the portion of FIG. 6, with the front fork support centered.
Figure 10:
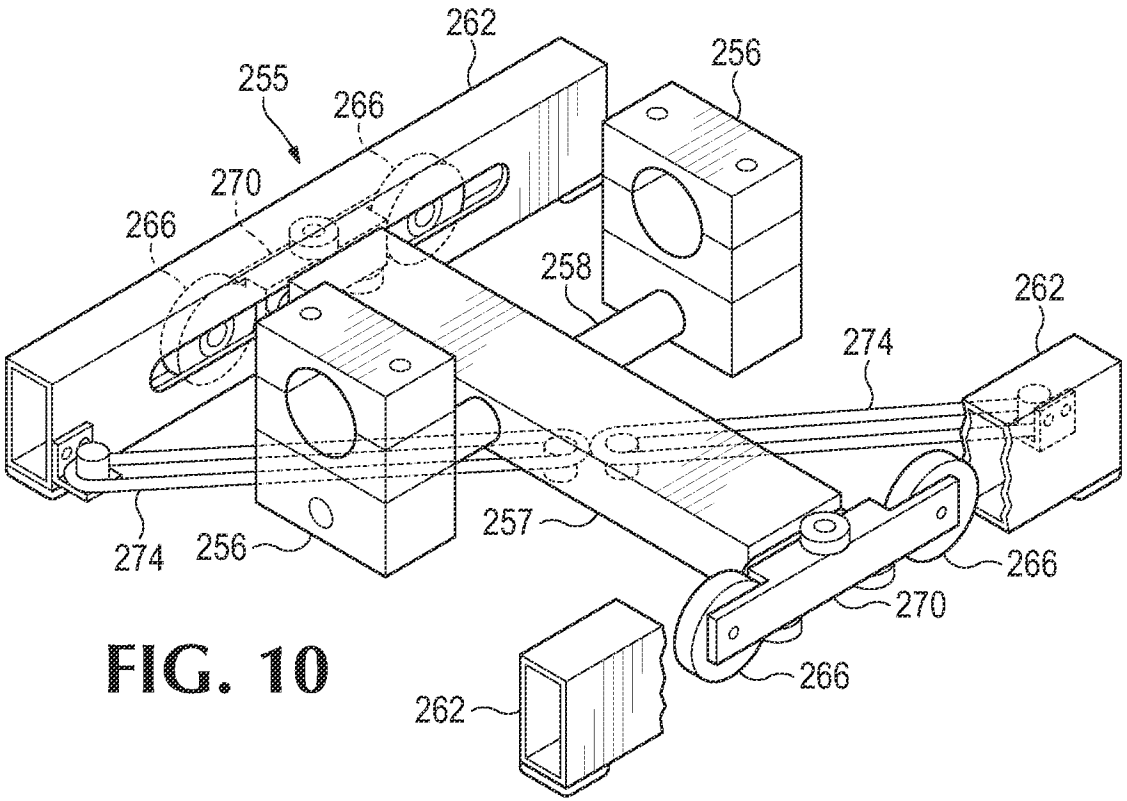
FIG. 10 is an isometric and cut-away view of the rear portion of the bicycle trainer of FIG. 6.
Figure 12:
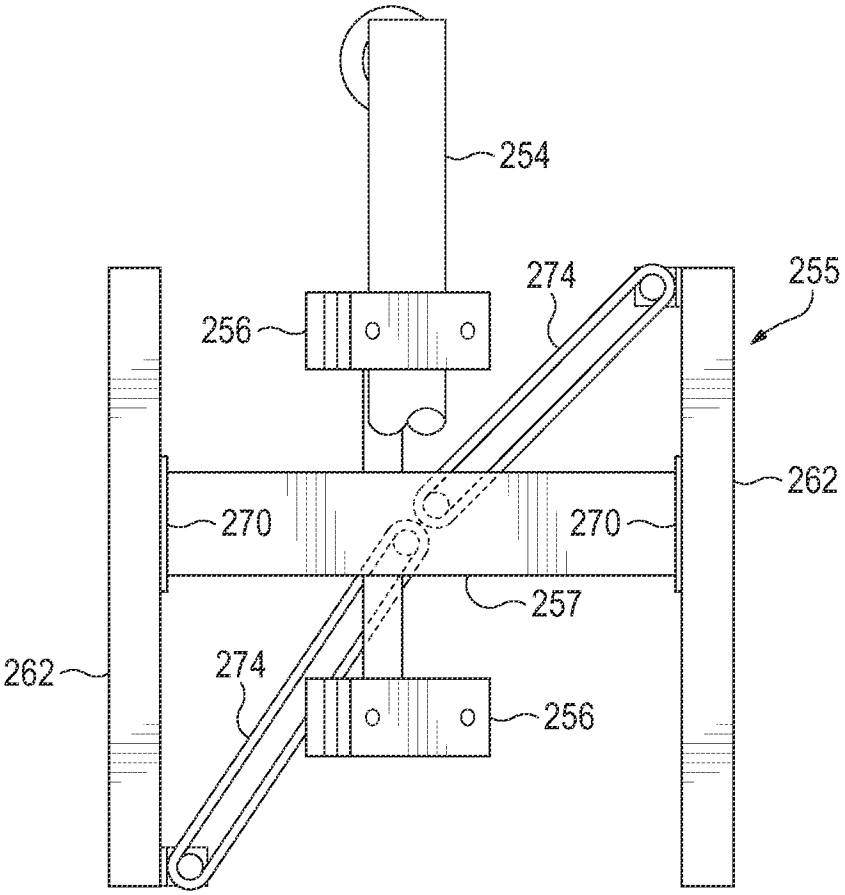
FIG. 12 is a top view of the portion of FIG. 10, with the rear support turned.
Figure 11:
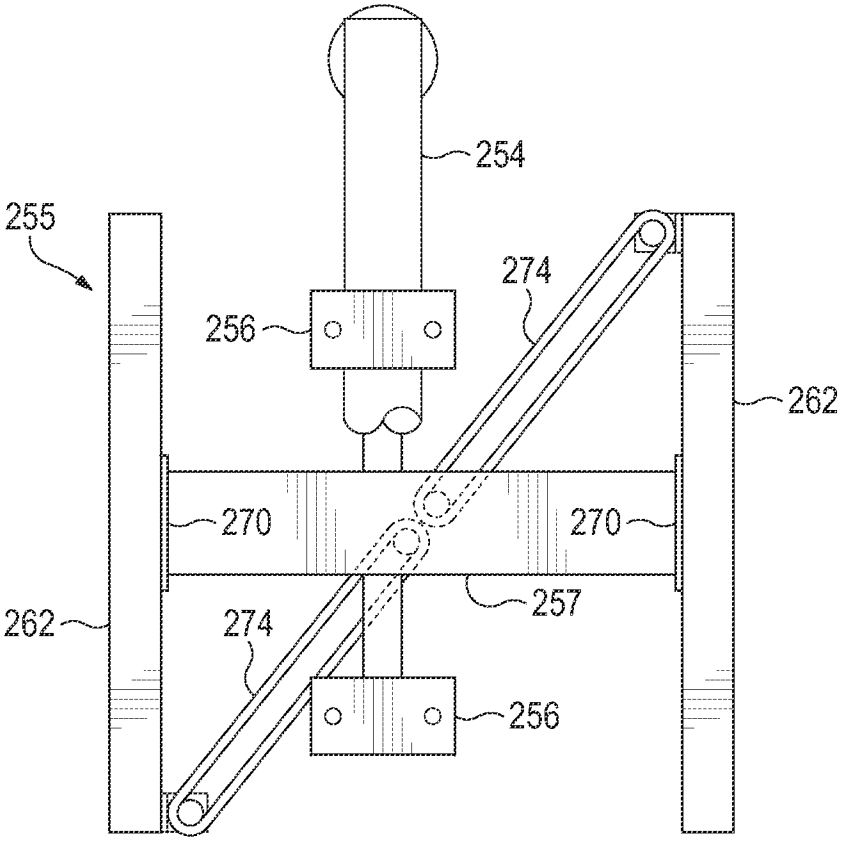
FIG. 11 is a top view of the portion of FIG. 10, with the rear support centered.

Referring to FIGS. 6-12, front support assembly 212 and rear support assembly 214 permit for and aft movement of bicycle portion 216, by including a pair front tracks 260 and rear tracks 262, front rollers 264 and rear rollers 266, and front carriages 268 and rear carriages 270, riding on rollers 264 and 266 respectively. A set of front rubber bands 272 and rear rubber bands 274 gently resist the fore and aft motion. Referring to FIGS. 8 and 9, FIG. 8 shows the front support assembly 212 with the carriage in an "at rest" position where rubber bands 272 are evenly tensioned. In FIG. 9, carriage 268 has moved forward relative to its position in FIG. 8, and the handle bar 241 has turned slightly to the left, thereby turning rear projection 227 to the left. Referring to FIGS. 11 and 12, FIG. 11 shows the carriage 270, and therefore cross beam 257 in a centered location, whereas FIG. 12 shows rear support assembly 214, as it would be if the front support assembly 212 was in the position of FIG. 9, with cross member 257 pulled forward slightly. Accordingly, the rearmost of elastic bands 274 is stretched and yolks 256 are rotated slightly to the right, as they would be if the handlebar 241 was turned slightly to the left as in FIG. 9.

The effect is a particularly realistic mimicry of the feel of actual bicycle riding, with the fore and aft movement mimicking the effects of inertia that cyclists feel, and the ability to steer the bicycle portion and to feel this portion lean as the rider turns the handle bar, provides a far more accurate feel of actual bicycle steering, than previously available trainers.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A bicycle training assembly having a rear and a front and comprising:

(a) a bicycle portion, including a bicycle frame including a rear wheel mount, pedals attached to a front sprocket, bicycle chain, seat, handlebar and front bicycle fork;

(b) a front support assembly, including:

(i) a front base;

(ii) a front bicycle fork support element horizontally rotatably mounted on said front base at a hinge point so as to permit horizontal rotation, and that includes a fork mount, supporting said bicycle fork, and displaced from said hinge point, so that as said support element rotates said fork mount revolves about said hinge point;

(c) a rear support assembly, including a rear base, and supporting said rear wheel mount, and engaged to said chain so as to permit and resist chain travel caused by rotation of said front sprocket, and permitting said frame to roll from side to side; and (d) wherein said front base and said rear base permit resisted forward and rearward motion over a range of less than 30 cm, for said bicycle portion and said rear base and front base include rear tracks and front tracks respectively, and a front carriage and rear carriage, respectively, that each ride on a set of rear rollers and front rollers, respectively, supported by said rear tracks and front tracks, respectively.

2. The bicycle training assembly of claim 1, wherein said rear support assembly includes:

(a) a rear wheel mount support assembly, mounted to said rear base, and including:

(i) a rear frame, having a rear wheel mount support, attached to and supporting said rear wheel mount;

(ii) a rear sprocket engaged to said chain, said rear sprocket rotatably mounted to a mechanism that permits but resists rotation, so that the rear sprocket resists chain travel caused by rotation of said front sprocket.

3. The bicycle training assembly of claim 2, wherein rear wheel mount support assembly includes further sprockets, all co mounted with said rear sprocket and said bicycle portion further includes a derailleur that can shift said chain from said rear sprocket to one of said further sprockets.

4. The bicycle training assembly of claim 2, wherein said rear wheel mount support assembly includes a rear wheel mount support assembly base that is laterally rotatably mounted to said rear support assembly base.

5. The bicycle training assembly of claim 4, wherein said rear wheel mount support assembly base includes a central horizontal leg, and two side lateral legs, and wherein said central horizontal leg is mounted to a holder that is rotatably mounted to said rear support assembly base.

6. A method of bicycle training, comprising:

(a) providing an assembly having a rear and a front and comprising:

(i) a bicycle portion, including a bicycle frame including a rear wheel mount, pedals attached to a front sprocket, bicycle chain, seat, handlebar and front bicycle fork;

(ii) a front support assembly, including: a base; a front bicycle fork support element horizontally rotatably mounted on said base at a hinge point so as to permit horizontal rotation, and that includes a fork mount, supporting said bicycle fork, and displaced from said hinge point, so that as said support element rotates said fork mount path revolves about said hinge point;

(iii) a rear wheel mount support assembly, supporting said rear wheel mount, and engaged to said chain so as to permit and resist chain travel caused by rotation of said front sprocket, and permitting said frame to roll from side to side;

(iv) a rear base, supporting said rear wheel mount support assembly; and (v) wherein said front base and said rear base permit resisted forward and rearward motion over a range of less than 30 cm, for said bicycle portion and said rear base and front base include rear tracks and front tracks respectively, and a front carriage and rear carriage, respectively, that each ride on a set of rear rollers and front rollers, respectively, supported by said rear tracks and front tracks, respectively;

(b) mounting said bicycle portion and peddling, and turning said handle bar, thereby causing said front bicycle fork support assembly to turn, so that said bicycle frame tilts.

7. The method of claim 6, wherein said rear wheel mount support assembly includes:

(a) a rear wheel mount support assembly base;

(b) a sprocket assembly, having:

a sprocket support and rotation resistance assembly supported by said rear wheel mount support assembly base and adapted to rotatably support and provide rotation resistance to a sprocket, which is rotatably supported by said sprocket support and rotation resistance assembly, which permits but resists rotation thereof;

(c) wherein said rear wheel mount support assembly base is supported by said rear base and that permits said rear wheel mount support assembly to roll from side to side, within a limited range; and (d) wherein when said bicycle frame tilts said rear wheel mount support assembly rolls on said rear base.

8. The method of claim 7, wherein said sprocket assembly includes further sprockets and said bicycle portion includes a derailleur engaged to said chain and adapted to move said chain from said sprocket to one of said further sprockets.

9. The method of claim 7, wherein said rear wheel mount support assembly base includes a central horizontal leg, and two side lateral legs, and wherein said central horizontal leg is mounted to a holder that is mounted to said rear support assembly base, and wherein when said bicycle frame tilts, said central horizontal leg rotates relative to said base.

* * * * *